US008899941B2

(12) United States Patent
Wilson et al.

(10) Patent No.: US 8,899,941 B2
(45) Date of Patent: Dec. 2, 2014

(54) SUBSEA PUMPING SYSTEM

(71) Applicant: Schlumberger Technology Corporation, Sugarland, TX (US)

(72) Inventors: Steve Wilson, Aberdeen (GB); Leonel Ruiz Contreras, Bogota (CO); Kevin T. Scarsdale, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/749,728

(22) Filed: Jan. 25, 2013

(65) Prior Publication Data

US 2013/0195684 A1 Aug. 1, 2013

Related U.S. Application Data

(62) Division of application No. 12/267,884, filed on Nov. 10, 2008, now Pat. No. 8,382,457.

(51) Int. Cl.
*F04B 23/04* (2006.01)
*F04B 17/03* (2006.01)

(52) U.S. Cl.
USPC ... 417/53; 417/423.3; 417/423.5; 417/423.15

(58) Field of Classification Search
USPC ..... 417/423.3, 423.15, 423.5, 62, 53; 166/368, 338, 334
See application file for complete search history.

(56) References Cited

U.S. PATENT DOCUMENTS

| | | | | |
|---|---|---|---|---|
| 3,319,373 | A | 5/1967 | Gale et al. | |
| 5,417,553 | A * | 5/1995 | Gibson et al. | 417/366 |
| 6,145,223 | A | 11/2000 | Flesen | |
| 6,443,660 | B1 | 9/2002 | Smith et al. | |
| 6,609,895 | B2 * | 8/2003 | Forthuber et al. | 417/22 |
| 6,640,901 | B1 * | 11/2003 | Appleford et al. | 166/357 |
| 6,873,063 | B1 * | 3/2005 | Appleford et al. | 307/149 |
| 7,059,345 | B2 | 6/2006 | Shaw | |
| 7,314,084 | B2 | 1/2008 | Rodrigues et al. | |
| 7,481,270 | B2 | 1/2009 | Shepler | |
| 7,516,795 | B2 * | 4/2009 | Lopes Euphemio et al. | 166/357 |
| 7,565,932 | B2 | 7/2009 | Lawson | |
| 7,713,031 | B2 | 5/2010 | Dane | |
| 8,083,501 | B2 | 12/2011 | Scarsdale | |
| 2006/0118310 | A1 * | 6/2006 | Euphemio et al. | 166/368 |
| 2006/0162934 | A1 | 7/2006 | Shepler | |
| 2006/0201679 | A1 | 9/2006 | Williams | |
| 2007/0110593 | A1 | 5/2007 | Sheth | |
| 2007/0235195 | A1 | 10/2007 | Lawson | |
| 2008/0282776 | A1 | 11/2008 | Loeb et al. | |
| 2009/0032264 | A1 | 2/2009 | Shepler | |
| 2009/0217992 | A1 | 9/2009 | Wilson | |

FOREIGN PATENT DOCUMENTS

GB 2267107 A * 11/1993

* cited by examiner

*Primary Examiner* — Devon Kramer
*Assistant Examiner* — Nathan Zollinger
(74) *Attorney, Agent, or Firm* — Michael Stonebrook

(57) ABSTRACT

A technique is provided for pumping fluid in subsea applications. A self-contained pumping module is created by mounting a pumping unit on a skid that can be lowered to a sea floor. The skid comprises a support structure designed to hold the pumping unit in a desired orientation, such as an inclined orientation with respect to a base of the skid. The self-contained nature of the pumping module facilitates deployment to a sea floor/retrieval from the sea floor to enable use of the pumping module in a variety of subsea applications with reduced complexity and cost.

11 Claims, 4 Drawing Sheets

SUBSEA PUMPING SYSTEM

BACKGROUND

In a variety of subsea applications, fluids are pumped from one region to another. For example, fluid can be produced upwardly from a subsea well, or fluid can be directed through subsea flowlines or injected into subsea wells. Sometimes existing pumping equipment is not adequate for a given task, and boosting pumps and equipment are added to the subsea equipment to facilitate the pumping applications. However, existing subsea pumping equipment used for boosting pumping capacity can be difficult and expensive to construct and/or use in the subsea environment.

SUMMARY

In general, the present invention provides a system and methodology for pumping fluid in subsea applications, such as booster pumping applications. A self-contained pumping module is created by mounting a pumping unit on a skid that can be lowered to a sea floor. The skid comprises a support structure designed to hold the pumping unit in a desired orientation, such as an inclined orientation with respect to a base of the skid. The self-contained nature of the pumping module enables easy deployment to a sea floor/retrieval from the sea floor, which allows the pumping module to be deployed in a variety of applications with reduced complexity and cost.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
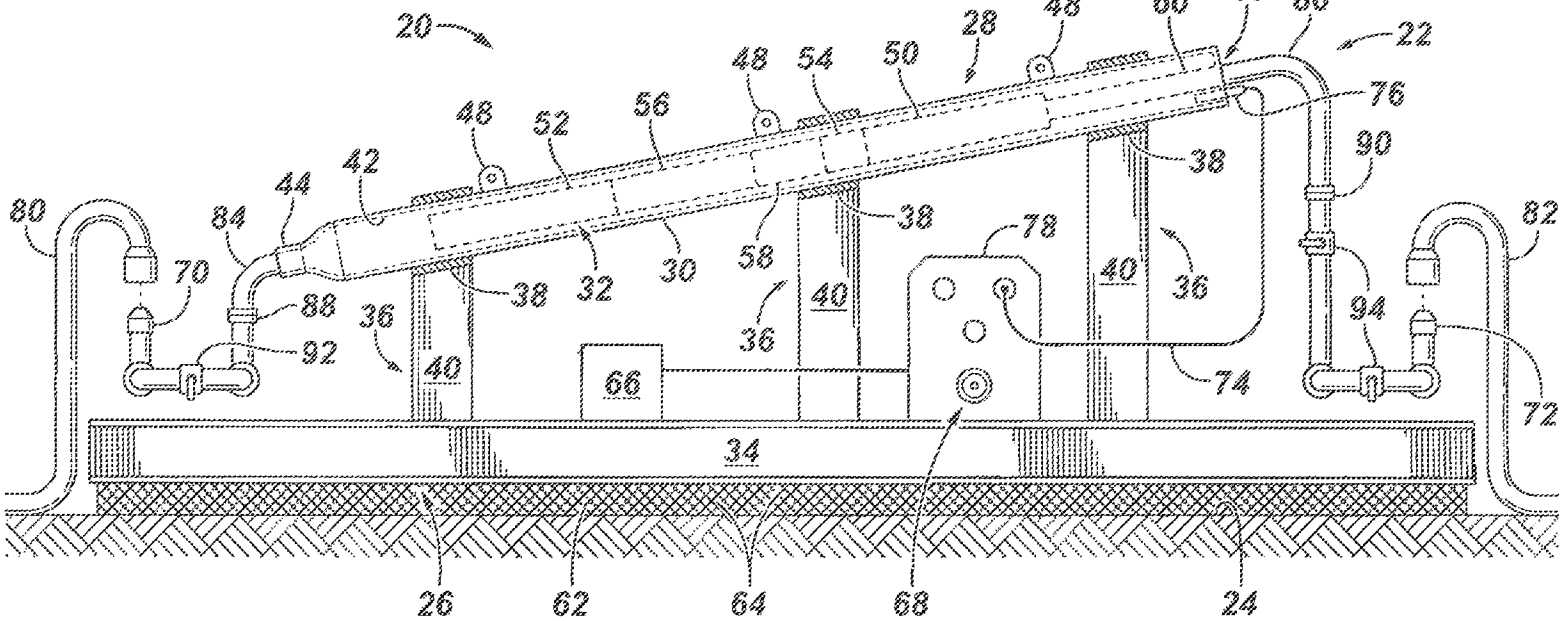
FIG. 1 is a front elevation view of one example of a self-contained pumping module, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and methodology for facilitating pumping of a fluid at a subsea location, e.g. a location proximate a subsea wellhead. The technique utilizes a self-contained pumping module that can be lowered to the sea floor and retrieved from the sea floor as a single module to provide additional pumping capacity without undue increases in time and costs. The overall system is simple in design and easy to install without any extensive site preparation. Additionally, the self-contained pumping module may have modular features that allow the pumping system to be tailored to specific application requirements.

In many applications, the self-contained pumping module is used to supplement or boost the pumping of fluids in a subsea environment without requiring major site preparation. The pumping module simply is lowered to the sea floor where hydraulic and electrical connections are easily made by, for example, use of a remotely operated vehicle. The pumping module is designed for positioning directly onto the sea floor. Because of the simple, self-contained design, positioning of the pumping module on the sea floor can be accomplished via a crane mounted on a work boat instead of requiring a workover rig, semi-submersible platform, or drilling rig.

By way of example, the self-contained pumping module can be used in boosting fluids from subsea wells when it is not practical, feasible or desirable to install large horsepower electric submersible pumping systems or other artificial lift systems into a subsea wellbore to produce a fluid to a surface location. The self-contained pumping module can be lowered to the sea floor near a wellhead, for example, to provide boosting to a surface platform, subsea processing facility, floating production, storage and offloading vessel, or other surface locations. In some applications, the pumping module can be placed downstream of subsea processing facilities to provide lift required to produce the fluid to the surface.

Apart from production applications, the self-contained pumping module also can be positioned at the sea floor and used to inject fluid into subsea wells. For example, the pumping module can be used to inject water to facilitate pressure maintenance of a reservoir. In this type of application, the pumping module can be connected to a suitable source of water, such as drilled water source wells, subsea processing facilities, surface processing facilities, or the surrounding ocean. In other applications, the self-contained pumping module can be used in the commissioning of subsea pipelines by removing the water used to sink and hydrostatically test the subsea pipelines. In many of these types of applications, the pumping module can be used to discharge the water directly into the ocean or to deliver the water to appropriate surface or subsea facilities.

Referring generally to FIG. 1, a pumping system 20 is illustrated according to one embodiment of the present invention. In this embodiment, pumping system 20 comprises a self-contained pumping module 22 that can be lowered to and retrieved from a sea floor 24. The self-contained pumping module 22 may be constructed in a variety of configurations with a variety of components, and several examples are described below.

In the embodiment illustrated in FIG. 1, the self-contained pumping module 22 comprises a skid 26 on which a pumping unit 28 is mounted. The pumping unit 28 may comprise one or more pumping units that are removably mounted to skid 26 to enable easy interchanging, e.g. replacement, of individual pumping units with other pumping units. As illustrated, pumping unit 28 comprises an outer housing 30, e.g. a pod, which encloses a pumping system 32, such as an electric submersible pumping system. As illustrated, the outer housing 30 and the internal pumping system 32 are constructed and positioned in an inclined orientation with respect to a base portion 34 of skid 26. However, pumping unit 28 may be mounted on skid 26 in a variety of orientations and with a variety of other mechanisms.

The one or more pumping units 28 are mounted on a pumping unit support structure 36 constructed to hold and support pumping unit(s) 28 in a desired orientation, such as the illustrated inclined orientation. The pumping unit support structure 36 is mounted on base portion 34 and may comprise a plurality of mounting brackets 38 designed to a grip and support pumping unit 28. By way of example, mounting brackets 38 may comprise a variety of latches, cradles, and/or clamps designed to readily secure pumping unit 28. In a variety of embodiments, mounting brackets 38 comprise releasable portions that may be actuated via, for example, a remotely operated vehicle or a separate control system, to enable easy interchanging of pumping units 28 while self-contained pumping module 22 is at a subsea location. In the example illustrated in FIG. 1, brackets 38 comprise a plurality of brackets that are positioned at sequentially more distant positions relative to the base portion so as to secure each pumping unit 28 at a desired, inclined orientation. Furthermore, pumping unit support structure 36 may be designed as an integrated structure disposed between base portion 34 and brackets 38, or the pumping unit support structure may comprise a plurality of independent substructures 40 dedicated to specific brackets 38.

In the embodiment illustrated, outer housing 30 may be tubular in design, such as a pipe, and sized to have an interior 42 that allows fluid, e.g. oil, to surround/submerge the pumping system 32. The outer housing 30 comprises a fluid inlet 44, through which fluid to be pumped enters interior 42, and a fluid discharge 46 through which pumped fluid exits outer housing 30. As illustrated, fluid inlet 44 and fluid discharge 46 are positioned on opposite ends of outer housing 30. Outer housing 30 also may comprise one or more lifting brackets 48 by which cables or other lifting mechanisms can be attached to remove and/or install one or more pumping units 28 during interchanging of pumping units.

Pumping system 32 is selected to fit within and operate within interior 42. In one embodiment, pumping system 32 comprises an electric submersible pumping system that can be designed in a variety of configurations. By way of example, electric submersible pumping system 32 comprises a pump 50, such as a centrifugal pump. A submersible motor 52, such as a three-phase motor, is operatively connected to pump 50. During operation of pump 50, fluid is drawn from the interior 42 into the pumping system 32 through a pump intake 54. A motor protector 56 may be positioned between submersible motor 52 and pump 50 to isolate dielectric oil inside motor 52 from the pumped fluid and to carry the hydraulic thrust of pump 50.

When pumping system 32 is constructed as an electric submersible pumping system, the system also may incorporate a variety of other components, such as a gas handling device 58 that may be an independent component or combined with intake 54. Examples of gas handling devices 58 include rotary gas separators and gas compression devices. As illustrated, electric submersible pumping system 32 may be connected to the fluid discharge end 46 of outer housing 30 via a discharge pipe 60 that extends from a discharge end of pump 50 to discharge outlet 46. The diameter and length of pump 50, as well as the size and power of motor 52, can be selected according to the desired flow rate and differential pressure for a given subsea application.

The various components of self-contained pumping module 22 are designed to work in a subsea environment. For example, base portion 34 and support structure 36 of skid 26 may be constructed from structural steel welded or otherwise fastened together to provide a rigid base. The structural steel or other suitable component also can be painted or otherwise coated to prevent corrosion during operation in the subsea environment. Additionally, skid 26 may comprise a lower support section 62 to secure the self-contained pumping module 22 on the sea floor. For example, lower support 62 may comprise a material or structure designed to secure the self-contained pumping module 22 in a typical seafloor constituent, such as mud or sand. In one embodiment, support 62 comprises a mesh material 64 constructed as a "mud mat" that securely positions pumping module 22 at a desired location, e.g. proximate a subsea wellhead, in the mud/sand of the sea floor.

The self-contained pumping module 22 also comprises a subsea control module 66 and a plurality of connectors, including one or more electrical connectors 68 and hydraulic connectors 70 and 72. In many applications, electrical connectors 68 are wet mate connectors that enable easy connection with a subsea power grid via suitable electric cables. Electric cables can be connected to the electrical wet mate connectors 68 by, for example, a remotely operated vehicle. In the specific example illustrated, electric cable or other types of electric lines 74 are used to connect motor 52 with the electric power supply. The electric lines 74 extend through outer housing 30 via a penetrator 76 and continue along the interior 42 for connection with submersible motor 52.

In one embodiment, the one or more electrical connectors 68 are mounted in a structure 78, such as a stab plate secured to skid 26. The stab plate may be mounted at various locations along the edge of the skid base portion 34 or at other suitable locations that enable easy connection with the subsea power grid or other source of power. The electric power supplied to self-contained pumping module 22 may be controlled by a control system which may include subsea control module 66. In addition or alternatively, control over the power signals can be provided by a control system located top side, on a floating production, storage and offloading vessel, on a production platform, or at a subsea location.

Similarly, hydraulic connectors 70, 72 may be formed as hydraulic wet mate connectors that enable easy connection of hydraulic lines 80, 82 via, for example, a remotely operated vehicle. The hydraulic inlet connector 70 may be connected to piping, e.g. hydraulic line 80, that extends directly from a subsea wellhead, a subsea processing facility, a subsea pipeline, or another subsea structure carrying fluid for which boosted fluid flow or other flow is desired.

In the embodiment illustrated, hydraulic connector 70 is coupled with fluid inlet 44 of outer housing 30 via a flow tubing 84; and hydraulic connector 72 is coupled with fluid discharge 46 of outer housing 30 via a flow tubing 86. Additional features also may be provided along flow tubing 84 and flow tubing 86. For example, hydraulic wet mate connectors 88, 90 may be connected along flow tubing 84, 86, respectively. The hydraulic wet mate connectors 88, 90 enable easy engagement and disengagement of each pumping unit 28 from the self-contained pumping module 22 during, for example, interchanging of pumping units.

Isolation valves 92, 94 also may be deployed along flow tubings 84, 86, respectively, to enable flow shutoff during removal of pumping unit 28. The isolation valves 22, 94 are actuated to an open, flow position when pumping unit 28 is engaged with self-contained pumping module 22. The subsea control module 66 can be used to control the actuation of isolation valves 92, 94. In some embodiments, control module 66 also is used to process data from or output data to various sensors and other instrumentation deployed on the self-contained pumping module 22.

Figure 2:
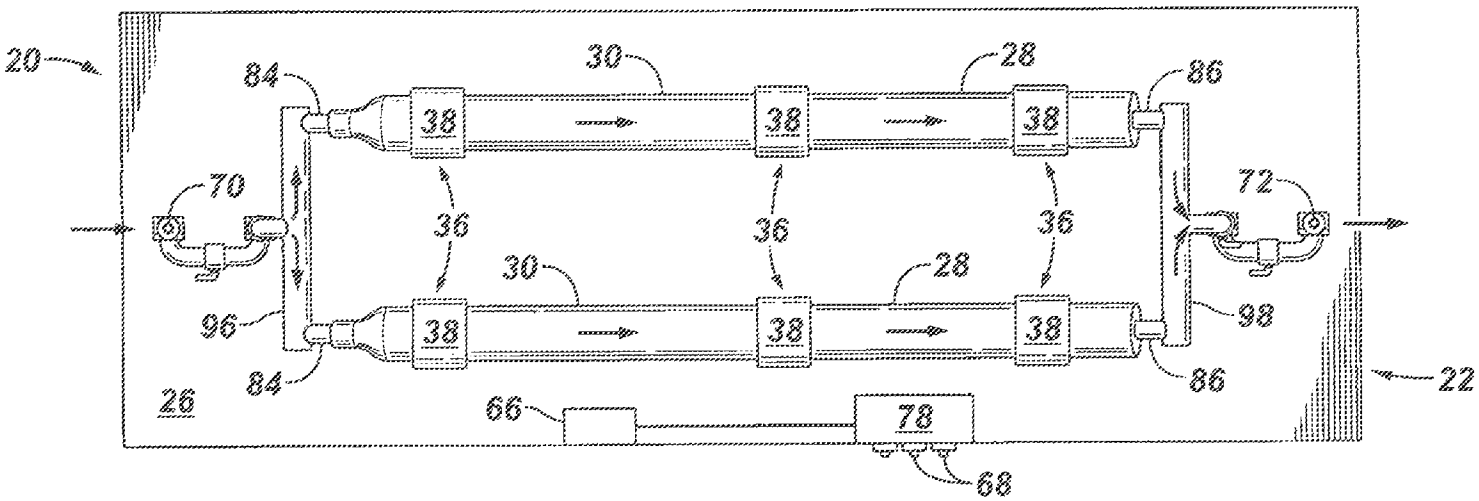
FIG. 2 is a top view of another example of the self-contained pumping module illustrated in FIG. 1, according to an embodiment of the present invention.
Figure 3:
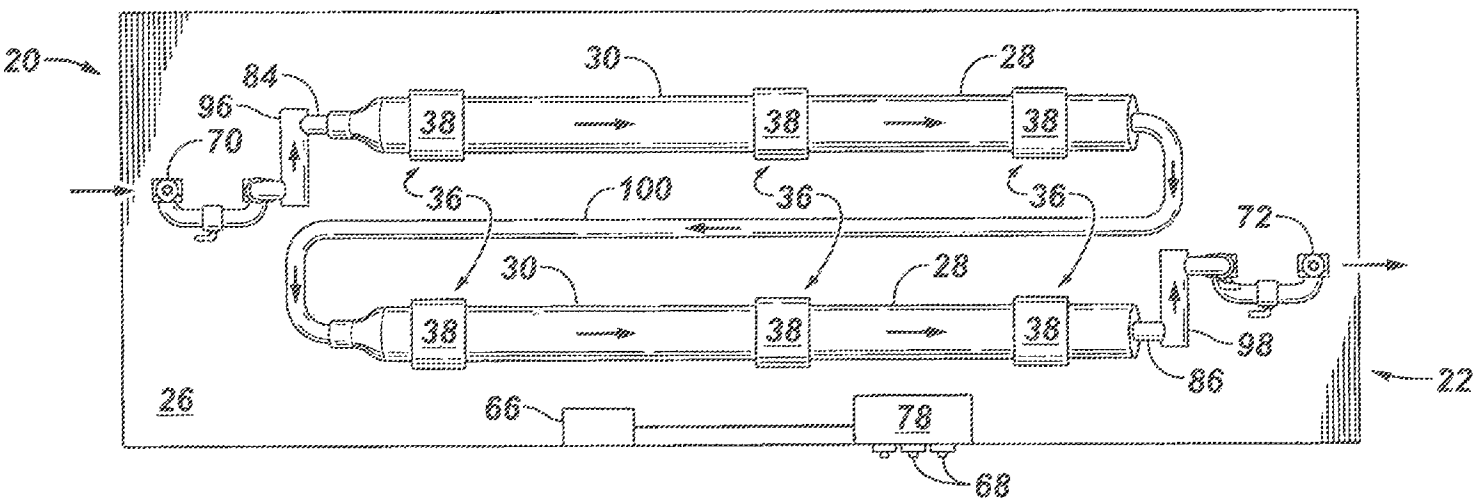
FIG. 3 is a top view of another example of the self-contained pumping module illustrated in FIG. 1, according to an embodiment of the present invention.

Referring generally to FIGS. 2 and 3, embodiments of self-contained pumping module 22 are illustrated to explain various arrangements of pumping units to achieve desired flow patterns and pumping capabilities. In the embodiment illustrated in FIG. 2, the pumping module 22 comprises a plurality of pumping units 28 mounted on a single skid 26. In this example, the series of pumping units 28 are mounted in parallel, and each unit comprises outer housing 30 and internal pumping system 32. During operation of pumping units 28, fluid is drawn in through the hydraulic line 80 coupled to hydraulic connector 70. The supplied fluid flows through hydraulic connector 70 and into an intake manifold 96 that supplies the individual intake flow tubes 84 for the plurality of pumping units 28. Once the fluid is pumped by the pumping units 28 and discharged through the fluid discharge 46 of each pumping unit, the fluid flows into a discharge manifold 98, out through hydraulic connector 72, and subsequently through hydraulic line 82.

Another embodiment of self-contained pumping module 22 is illustrated in FIG. 3. In this embodiment, a plurality of pumping units 28 is again arranged on the single skid 26. In the particular example illustrated, the pumping units 28 are connected in series via a tubing 100 to increase the boost pressure compared to a single pumping unit. Although FIGS. 2 and 3 only illustrate pairs of pumping units 28, it should be noted that additional pumping units 28 can be added and connected either in parallel or in series as desired for a specific application. Various combinations of parallel and serial connections also can be made according to the pumping requirements. For example, two pairs of serially connected pumping units 28 can be operated in parallel, via connections to intake manifold 96 and discharge manifold 98, to provide twice the flow rate relative to a single pair of the pumping units 28 connected in series. Additionally, individual pumping units 28 or combinations of pumping units 28 can be separated via isolation valves and retained as redundant or backup units.

Figure 4:
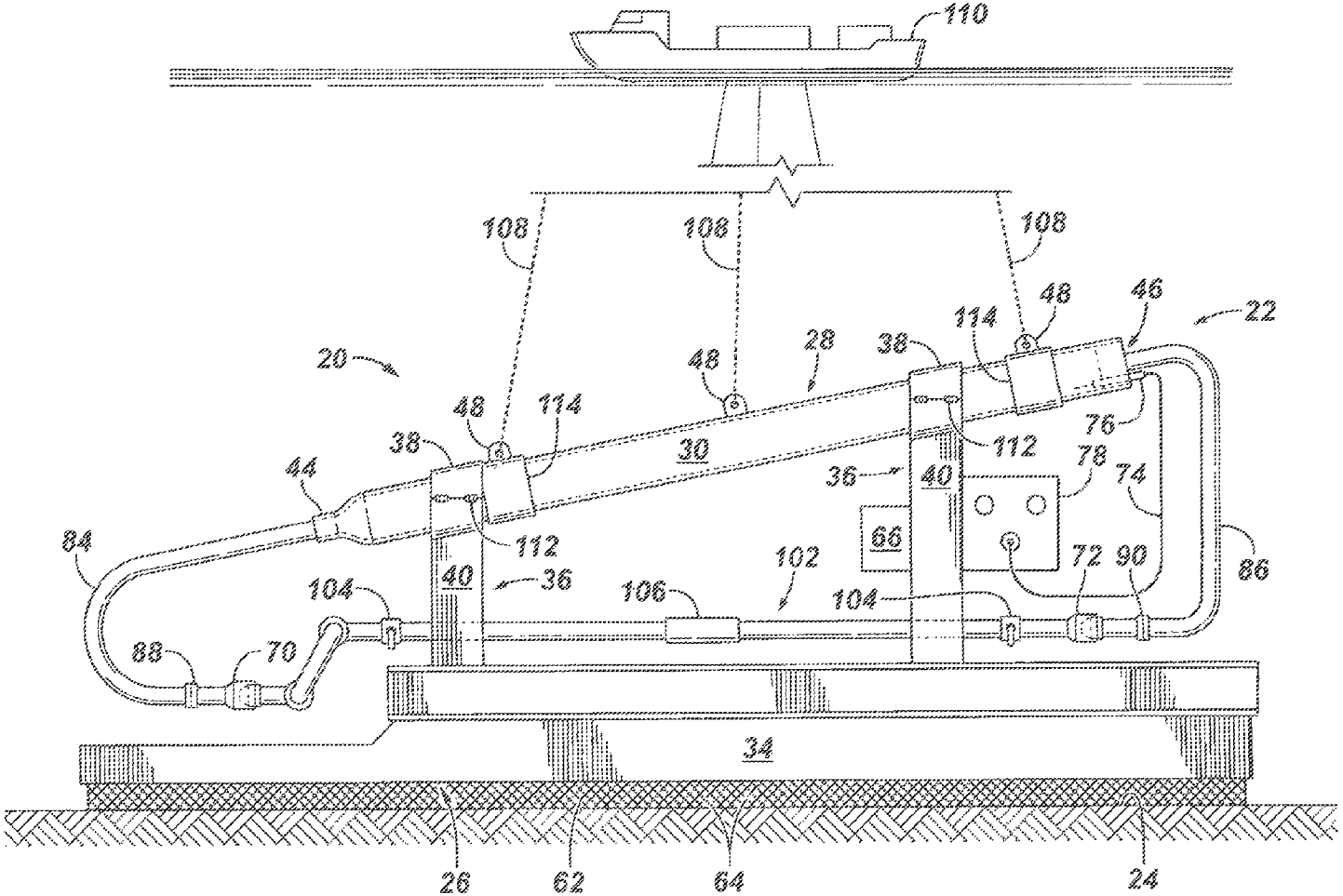
FIG. 4 is a front elevation view of another example of the self-contained pumping module illustrated in FIG. 1, according to an alternate embodiment of the present invention.

Referring generally to FIG. 4, another embodiment of self-contained pumping module 22 is illustrated. In this embodiment, one or more pumping units 28 are mounted on skid 26 in a generally inclined orientation. Additionally, the self-contained pumping module 22 also may comprise a bypass 102 to allow fluid flow to continue when pumping units 28 are removed, e.g. replaced. For example, an individual bypass may be associated with each pumping unit 28. In some applications, gas lift can be used in cooperation with the bypass 102 to provide moderate boosting during a change out cycle. The bypass 102 also may comprise isolation valves 104 to allow flow in a bypass mode and to block flow during operation of pumping unit 28.

The actuation of isolation valves 104, as well as the actuation of isolation valves 92, 94, can be controlled via subsea control module 66 alone or via control module 66 in combination with an additional control system, such as a surface control system. The subsea control module 66 can further be used to control other components or to receive data from other components. For example, control module 66 may be coupled with a sensor 106, e.g. flow sensor, mounted in bypass 102.

In a variety of applications, additional instrumentation can be added to self-contained pumping module 22 to monitor other parameters related to the pumping operation. For example, the instrumentation may comprise sensors, such as temperature sensors, pressure sensors, flow rate sensors and other sensors. The instrumentation also may include other types of components used to provide feedback and/or to control specific functions, such as the opening and closing of valves. Various instruments can be operatively connected with subsea control module 66 and/or a separate control system, such as a surface control system.

As illustrated in FIG. 4, individual pumping units 28 are readily interchanged simply by connecting suitable lifting mechanisms 108, e.g. lifting cables, with lifting brackets 48. Each individual pumping unit 28 can be removed from self-contained pumping module 22 by lifting the pumping unit to a work boat 110, for example. Similarly, a new or reconditioned pumping unit 28 can be returned to the self-contained pumping module 22 via lifting mechanisms 108. Each pumping unit 28 is secured to and released from skid 26 via brackets 38. By way of example, brackets 38 may comprise clamping members sized to clamp against housing 30 of each pumping unit. The clamping members can be moved between open and closed positions by, for example, suitable hinge mechanisms 112. It should be noted, however, that a variety of other types of brackets 38 can be used to selectively secure each pumping unit 28 to skid 26. Similarly, a variety of wet mate connectors 88, 90 can be used to enable easy disconnection and reconnection of hydraulic lines during interchanging of pumping units. In some applications, a remotely operated vehicle can be used to assist opening and closing brackets 38 and to assist in disconnecting and reconnecting wet mate connectors 88, 90. A plurality of locating collars 114 can be positioned on outer housing 30 and used to properly locate each pumping unit in an axial direction with respect to the brackets 38.

The size, configuration, and component types used to construct self-contained pumping module 22 can be varied to accommodate many types of subsea pumping applications, including production fluid boosting applications and injection applications. An individual pumping unit can be mounted on the skid, or a plurality of pumping units can be mounted on the skid in many configurations, including parallel configurations, serial configurations, and numerous combinations of parallel and serial configurations. The pumping units can be mounted at selected angular orientations with respect to a base portion of the skid. Additionally, the materials and structure of skid 26 can be selected to accommodate easy positioning of the self-contained pumping module 22 directly onto seafloor 24. The skid 26 can be deployed to many types of locations for use in a variety of subsea pumping applications, including the boosting of fluid flow from subsea wells. Similarly, the position and configuration of the wet mate connectors, both hydraulic and electrical, can vary from one application to another to accommodate easy connection of electric lines and hydraulic lines.

Although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

The invention claimed is:

1. A method for pumping fluid at a subsea location, comprising:

sliding a skid along a sea floor to a selected location, the skid including support structures having a plurality of brackets for releasably attaching multiple pump modules to the skid, each pump module attachable undersea and detachable undersea for module replacement;

providing onboard control of multiple different configurations of a flow path for pumped fluid or gas lift via a control module mounted on the skid;

receiving sensor inputs from multiple flow sensors and multiple valve state sensors of the multiple pump modules;

configuring the multiple pump modules via the control module to create a flow path at the subsea location from a selection of multiple different configurations of a flow path for pumped fluid or gas lift; and maintaining a fluid output of the multiple pump modules via the configuring during attachment and detachment of one or more of the multiple pump modules for replacement.

2. The method of claim 1, further comprising:

constructing the skid to position the multiple pumping modules in a desired orientation;

mounting the multiple pumping modules to the skid to create a self-contained booster pump module.

3. The method as recited in claim 2, further comprising connecting hydraulic lines to the self-contained booster pump module while positioned on the sea floor.

4. The method as recited in claim 3, further comprising connecting at least one electric line to the self-contained booster pump module while positioned on the sea floor.

5. The method as recited in claim 2, wherein constructing comprises constructing the skid to releasably mount the multiple pumping modules in an inclined orientation relative to the sea floor.

6. The method as recited in claim 2, wherein mounting comprises releasably mounting the multiple pumping modules.

7. The method as recited in claim 6, further comprising mounting a fluid bypass on the skid.

8. The method of claim 1, further comprising:

constructing a base portion of the skid with a mat material;

attaching a pump module support structure to the base portion; and orienting brackets of the pump module support structure to releasably hold a pump module at a desired incline with respect to the base portion.

9. The method as recited in claim 8, further comprising mounting the pump module to the pump module support structure so that an electric submersible pumping system within an outer housing of the pump module is oriented at the desired angle.

10. The method as recited in claim 9, further comprising coupling hydraulic and electric wet mate connectors to the pump module.

11. The method as recited in claim 10, further comprising mounting a fluid bypass on the skid to enable selective bypassing of the pump module.

* * * * *